US007470079B2

(12) United States Patent
Bedhome et al.

(10) Patent No.: US 7,470,079 B2
(45) Date of Patent: Dec. 30, 2008

(54) WRITING ARTICLE HAVING A CAPILLARY RESERVOIR WITH IMPROVED INK DELIVERY

(75) Inventors: Vincent Rene Michel Bedhome, Desvres (FR); Didier Lange, Saint Leonard (FR)

(73) Assignee: Conte, Boulogne sur Mer (FR)

( * ) Notice: Subject to any disclaimer, the term of this patent is extended or adjusted under 35 U.S.C. 154(b) by 390 days.

(21) Appl. No.: 10/522,179

(22) PCT Filed: Jun. 6, 2003

(86) PCT No.: PCT/FR03/01713

§ 371 (c)(1),
(2), (4) Date: Oct. 24, 2005

(87) PCT Pub. No.: WO2004/016448

PCT Pub. Date: Feb. 26, 2004

(65) Prior Publication Data

US 2006/0104706 A1 May 18, 2006

(30) Foreign Application Priority Data

Jul. 26, 2002 (FR) ..... 02 09570

(51) Int. Cl.
*B43K 5/00* (2006.01)
*B43K 5/02* (2006.01)

(52) U.S. Cl. ..... 401/199; 401/198; 401/40; 401/41

(58) Field of Classification Search ..... 401/198, 401/199, 40–42, 205
See application file for complete search history.

(56) References Cited

U.S. PATENT DOCUMENTS

| | | | | |
|---|---|---|---|---|
| 2,061,405 | A * | 11/1936 | Kingman et al. | 401/40 |
| 2,879,744 | A * | 3/1959 | Goldman et al. | 401/40 |
| 3,720,473 | A * | 3/1973 | Nakata | 401/40 |
| 5,433,545 | A | 7/1995 | Keil | |
| 6,244,774 | B1 | 6/2001 | Lang et al. | |

FOREIGN PATENT DOCUMENTS

| | | |
|---|---|---|
| DE | 3642037 | 6/1988 |
| GB | 2194138 | 3/1988 |

* cited by examiner

*Primary Examiner*—David J Walczak
(74) *Attorney, Agent, or Firm*—Millen, White, Zelano, Branigan, P.C.

(57) ABSTRACT

A writing instrument having a body, a main reservoir containing ink and housed in said body, a writing head projecting from the front part of said body, and a capillary connector for transferring ink from the main reservoir to the writing head. The instrument has an auxiliary reservoir containing an ink carrier liquid, and an actuator for releasing said liquid from the auxiliary reservoir so that said liquid flows into the main reservoir and expels the ink towards the connector. The carrier liquid contains the ink solvent, in particular water in the case of a water-based ink, and preferably contains all or any of the components of the ink in the main reservoir, whereby the original writing properties of the residual ink carried by the carrier liquid are preserved.

16 Claims, 2 Drawing Sheets

WRITING ARTICLE HAVING A CAPILLARY RESERVOIR WITH IMPROVED INK DELIVERY

The present invention relates to writing instruments in which ink is trapped in a capillary reservoir. It relates more particularly to a writing instrument of this type with improved ink delivery.

BACKGROUND OF THE INVENTION

In a writing instrument that includes a capillary reservoir, a capillary connector transfers ink from the capillary reservoir to the writing head, which may be either an independent part or the front end portion of the connector. The capillary reservoir usually consists of an array of fibers. The fibers may be acetate or polyester fibers, for example.

As the instrument is used, the ink that is consumed from the writing head is replaced with ink from the capillary reservoir. A major drawback of that type of instrument is that not all of the ink that is injected into the capillary reservoir during fabrication of the instrument is delivered for writing. It is found that a certain proportion of the ink contained in the capillary array of the reservoir remains there at the end of the life of the instrument. The proportion of the ink that is not delivered is generally estimated at around 20%.

This is a drawback in more ways than one. Firstly, the unconsumed ink increases the cost of the instrument. Secondly, the residual ink pollutes the environment. Finally, the residual ink causes problems with recycling spent instruments.

OBJECT AND SUMMARY OF THE INVENTION

The aim of the present invention is to overcome the observed drawbacks of writing instruments including a capillary reservoir by improving the ink delivery of such instruments.

The above object is entirely achieved by a writing instrument which, in the manner that is known in the art, comprises a body, a main reservoir containing ink and housed in said body, a writing head projecting from the front part of said body, and a capillary connector for transferring ink from the main reservoir to the writing head. Characteristically, according to the invention, said writing instrument also comprises an auxiliary reservoir containing an ink carrier liquid, and actuator means for releasing said liquid from the auxiliary reservoir so that said liquid flows into the main reservoir and expels the ink towards the connector.

The actuator means are naturally operated by the user on noticing that the quality of the writing produced by the instrument is deteriorating. The function of the carrier liquid is to cause ink that is contained in the capillary array of the reservoir that would not migrate naturally during normal use of the instrument to be displaced towards the connector. The ink carried by the carrier liquid reaches the connector and the instrument can continue to be used until all of the ink is consumed.

The carrier liquid providing the above function preferably contains the ink solvent. In particular it contains water in the case of a water-based ink.

The carrier liquid injected into the main reservoir displaces the residual ink remaining in said reservoir, but may degrade the original writing characteristics of the ink on mixing therewith. To overcome this problem, it is preferable for the carrier liquid to contain all or any of the ink components that confer its writing properties upon the ink and whose presence in the carrier liquid allows the original writing properties of the residual ink mixed with the carrier liquid to be preserved.

For example, in the case of a writing instrument using water-based ink, the carrier liquid contains a certain proportion of glycol, in particular of the order of 20% to 30% glycol, which is used in the art to increase the solubility in water of certain constituents of a water-based ink.

For example, in the case of a writing instrument using a dry-wipe ink, the carrier liquid contains a resin used in the art to confer its dry-wipe property on the ink.

The carrier liquid may contain additives promoting its operation, in particular surfactants.

In one embodiment, the auxiliary reservoir is also made of fibrous material; when the actuator means are operated, the auxiliary reservoir is placed in contact with the rear portion of the main reservoir.

In this variant, the main and auxiliary reservoirs are preferably both disposed in the body of the instrument in the same longitudinal direction. The front face of the auxiliary reservoir is therefore applied to the rear face of the main reservoir when they are brought into contact. The carrier liquid contained in the auxiliary reservoir diffuses by capillarity into the main reservoir when they are brought into contact.

Preferably, the capillarity of the auxiliary reservoir is lower than that of the main reservoir. The advantage of this is that it facilitates starting the transfer of carrier liquid from the auxiliary reservoir to the main reservoir when they are brought into contact.

In a different embodiment, the auxiliary reservoir is formed of a spongy mass impregnated with the carrier liquid. When the actuator means are operated, the spongy mass is compressed, thereby releasing the carrier liquid that it contains.

In a further embodiment, the carrier liquid is in the liquid state in the auxiliary reservoir. The instrument comprises means for opening said auxiliary reservoir to release the carrier liquid contained therein when the actuator means are operated.

From a structural point of view, the auxiliary reservoir, of whatever kind, is accommodated in an actuator member that is adapted to slide relative to the portion of the body of the instrument containing the main reservoir, the connector and the writing head, for example. Note that the displacement of this actuator member initiating release of the carrier liquid is reflected in a reduction in the length of the instrument, which has the advantage of allowing users to tell at a glance that the auxiliary reservoir has been actuated.

BRIEF DESCRIPTION OF THE DRAWINGS

The present invention will be better understood on reading the following non-exhaustive description of embodiments of writing instruments with improved ink delivery, which description is illustrated by the appended drawing, in which.

MORE DETAILED DESCRIPTION

Figure 1:
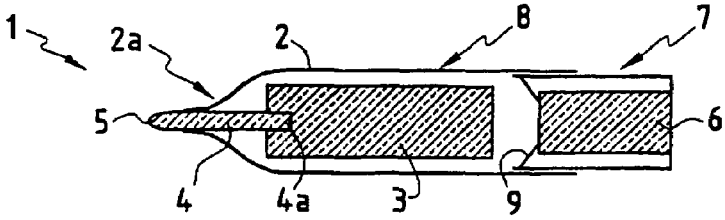
FIGS. 1 to 4 show diagrammatically four steps of the main operation of the instrument.

The user realizes that the writing instrument being used is running out on noticing a reduction in the intensity of the color of the writing, as is caused by a relative reduction in the flow of ink from the reservoir. This applies in particular with writing instruments in which the ink is trapped in a capillary reservoir, especially a fibrous reservoir. At present, on noticing this, the user has no option but to discard the instrument, possibly once some minimum acceptable color intensity is reached.

It is found that under these extreme conditions the capillary reservoir still contains ink that is trapped in the fibrous array and that is not delivered for the purposes of writing during normal use of the instrument.

The present invention improves the ink delivery of the instrument by using a carrier liquid to expel the residual ink contained in the capillary reservoir until virtually all of the ink has been consumed, the carrier liquid being released by the user operating actuator means on noticing that the writing is of reduced color intensity.

The auxiliary reservoir containing the carrier liquid therefore co-operates with an actuator member that has an inactive position in normal use of the instrument, and an active position that releases the carrier liquid. In the inactive position, ink is transferred from the main reservoir to the writing head, and in the active position the carrier liquid contained in the auxiliary reservoir is transferred to the main reservoir to expel the residual ink that it still contains, so that the ink goes towards the connector.

FIGS. 1 to 4 show this general principle that is characteristic of the invention in one particular embodiment of the invention.

This embodiment of the invention consists in a writing instrument 1 that comprises a body 2, a main reservoir 3 and a transfer tip 4 that has an end that projects beyond the front portion 2*a* of the body 2 and serves as a writing head 5.

The body 2 of the instrument has a rear part 7 adapted to slide relative to the main part 8 of the body 2. This rear part 7, which constitutes the actuator part characteristic of the invention, provides a housing for an auxiliary reservoir 6. In the embodiment shown here, the rear part 7 has an outside diameter that is chosen in relation to the inside diameter of the main part 8 so that, when it slides, the rear part 7 penetrates into the space inside the main part 8 whilst maintaining a seal.

The main reservoir 3 contains writing ink suitable for the instrument 1. The auxiliary reservoir contains a carrier liquid adapted to migrate by capillary action into the main reservoir and to expel residual ink contained therein towards the transfer point 4. This carrier liquid contains the ink solvent, which is water in the case of a water-based ink, and various additives, in particular surfactants adapted to promote the flow of ink upon migration of said liquid into the main reservoir.

The two reservoirs 3, 6 are both made from a fibrous material in the conventional way.

The transfer tip 4, whose front end constitutes the writing head 5, has a rear end 4*a* that penetrates into the fibers of the front portion of the main reservoir 3.

FIG. 1 shows the respective positions of the main reservoir 3 and the auxiliary reservoir 6 during normal use of the instrument. The two reservoirs are at a distance from each other; in particular, a system of tongues 9 pushes the auxiliary reservoir 6 towards the rear end of the rear part 7, preventing said auxiliary reservoir 6 from coming into contact with the main reservoir 3, in particular when the instrument 1 is in a position such that the tip is at the bottom.

Figure 2:
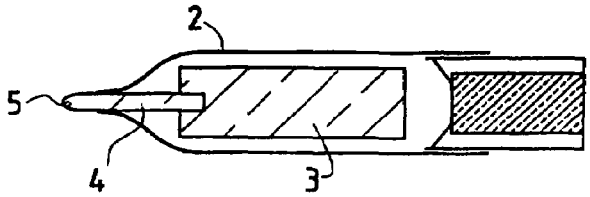

Ink consumed by the writing head 5 during use of the instrument 1 is replaced by ink contained in the main reservoir 3 and transferred by the transfer tip 4 to the writing head 5. When the greater part of the ink contained in the reservoir 3 has been consumed, a reduction in the quantity of ink reaching the writing medium causes the user to notice that the quality of the writing is deteriorating. FIG. 2 shows this particular stage of the use of the instrument, the number of shading lines on the main reservoir 3 and the transfer tip 4 showing that a certain quantity of ink remains in the main reservoir but is insufficient to achieve good writing quality. This tells the user to activate the auxiliary reservoir 6.

This is achieved simply by applying pressure to the rear end 7*a* of the rear part 7 of the body 2 so as to move this rear part 7 in the direction of the arrow F, said rear part 7 entering partly into the space inside the main part B. During this displacement, the front face 6*a* of the auxiliary reservoir 6 comes into contact with the rear face 3*a* of the main reservoir 3. The carrier liquid contained in the auxiliary reservoir 6 migrates into the main reservoir 3, as a result of capillary action, and expels the residual ink that it contains towards the transfer tip 4, and thus towards the writing head 5. To optimize this capillary diffusion of the carrier liquid, it is preferable if the capillarity of the main reservoir 3 is higher than that of the auxiliary reservoir 6; providing this difference in capillarity is a simple way to overcome any barrier that might be imposed by the interface between the two reservoirs 6, 3. In the case of a fibrous reservoir, this kind of difference in capillarity may be obtained by reducing the density of the fibers in the auxiliary reservoir compared to that of the main reservoir, for example. The auxiliary reservoir 6 preferably has a fiber density that is 80% to 95% of the fiber density of the main reservoir. For example, in a marker, with the fiber density of the main reservoir being of the order of 0.23 grams per cubic centimeter ($g/cm^3$), a fiber density of the order of 0.20 $g/cm^3$ is chosen for the auxiliary reservoir.

Accordingly, because of the contact between two reservoirs 3, 6, it is again possible to use the writing instrument 1 under normal conditions, but only for a limited time period that depends on the residual quantity of ink in the main reservoir 3.

Figure 3:
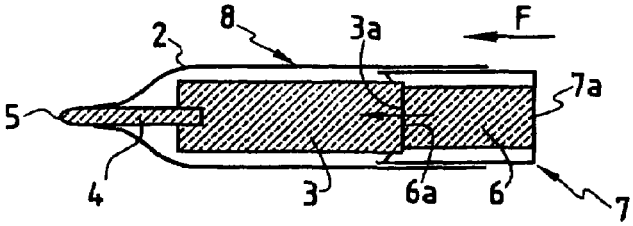
Figure 4:
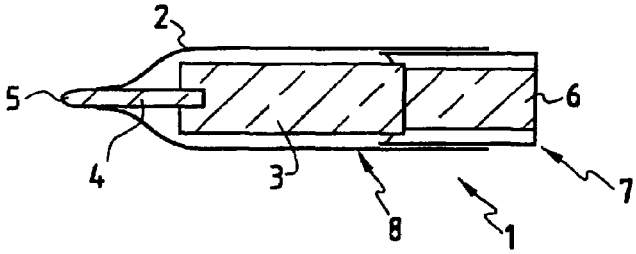

FIG. 3 shows this continued use, involving transfer of the carrier liquid from the auxiliary reservoir 6 to the main reservoir 3, and FIG. 4 shows the instrument 1 at the end of its life, when all of the ink has been consumed and the instrument must therefore be discarded.

The quantity of carrier liquid contained in the auxiliary reservoir 6 must be just sufficient to expel the residual quantity of ink contained in the main reservoir 3, which on average is of the order of 20% to 40% of the original quantity of ink injected into said main reservoir 3 (depending on the type of ink used).

In this case, the quantity of carrier liquid in the auxiliary reservoir 6 is preferably of the order of 20% to 40% of the quantity of ink in the main reservoir of the instrument.

Independently of this option for temporarily prolonging the service life of the instrument by consuming residual ink contained in the main reservoir 3, the actuation of the rear part 7 causes a deformation of the body of the instrument 1 that shows a user that said instrument is in its final phase of use, with no possibility of further extension of its useful life. This actuation, i.e. the depression of the rear part 7 into the main part 8 of the body 2, reduces the length of the body 2 of the instrument 1. Information is provided, where applicable on the body of the instrument, to advise the user of the active and inactive positions of the rear part 7 and that it is important to obtain a replacement instrument once the rear part 7 has been moved to the active position.

Clearly, the body 2 of the instrument must be equipped with means for holding the rear part 7 in the inactive position during normal use, then actuating it and finally retaining it in the inward position.

Figure 5:
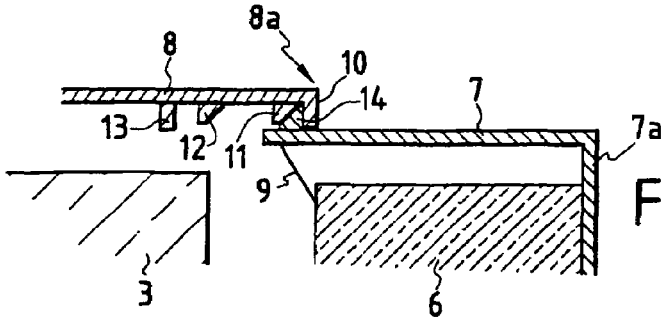
FIGS. 5 and 6 are diagrammatic fragmentary views in longitudinal section of an instrument with main and auxiliary fibrous reservoirs, the auxiliary reservoir being slideably mounted in a rear portion of the body of the instrument and shown in an inactive position in FIG. 5 and in an active position in FIG. 6.
Figure 6:
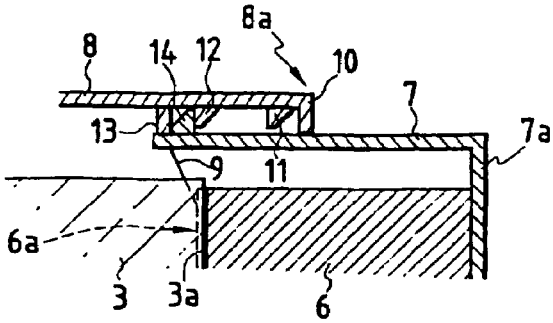
Figure 7:
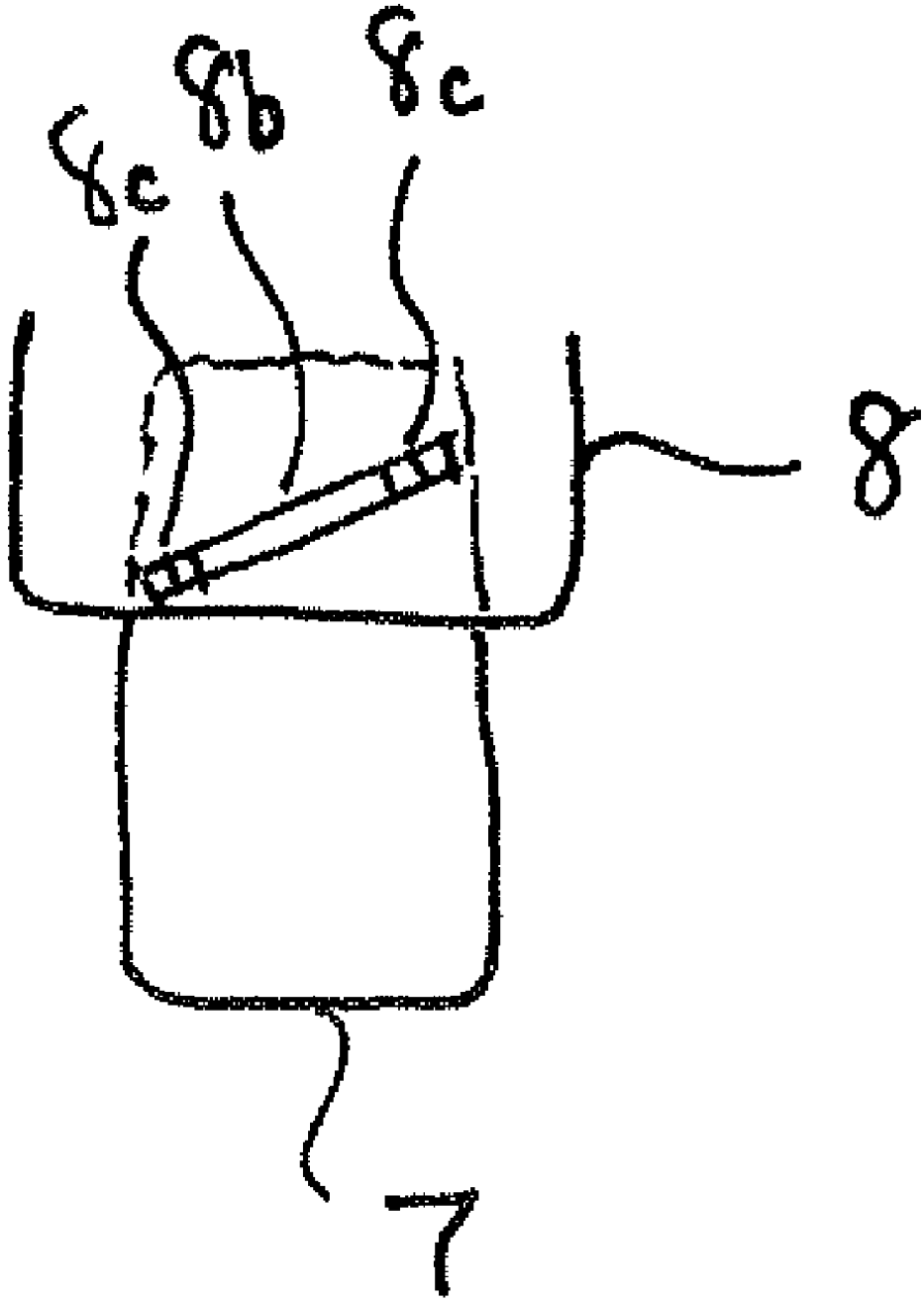
FIG. 7 shows the relation of the components at the rear of the instrument.

FIGS. 5 and 6 show one particular arrangement for retaining the rear part 7 relative to the main part 8 of the body 2 in this way.

The rear part 7, which is generally cylindrical, is closed off by a rear end 7*a* and open at its other end for inserting the auxiliary reservoir 6. Near its open end, the rear part 7 has an annular shoulder 14 of substantially frustoconical shape on its outside periphery, with the inclined surface facing towards the front end of the instrument. The main part 8 of the body 2 has four annular shoulders 10 to 13 on its inside periphery of which a first shoulder and a fourth shoulder form definitive abutments and a second shoulder and a third shoulder, having a frustoconical shape complementary to that of the shoulder carried by the actuator part, form temporary abutments. The first shoulder 10 extends towards the interior of the instrument from the edge 8*a* at the end of the main part 8. The second shoulder 11 is at a small distance from the first shoulder 10 and has a frustoconical shape complementary to that of the shoulder 14 on the rear part 7. To be more precise, and as is clear from FIG. 5, the shoulder 14 of the rear part 7 is disposed between the first two shoulders 10, 11, with the inclined surface of the shoulder 14 of the rear part 7 pressed against the inclined face of the second shoulder 11 of the main part 8. In the inactive position shown in FIG. 5, the shoulder 14 of the rear part 7 is temporarily immobilized between the first two shoulders 10, 11 on the main part 8. However, because of the complementary shape of the shoulders 14 and 11 and the deformability of the materials used, it is sufficient to apply adequate pressure to the rear end 7*a* of the part 7 to force the shoulder 14 on the rear part 7 beyond the second shoulder 11 of the main part 8 and move the rear part 7 relative to the main part 8.

The third shoulder on the main part 8 has the same configuration as the second shoulder 11. Similarly, the fourth shoulder 13 has the same configuration as the first shoulder 10. Accordingly, on displacement of the rear part 7, the shoulder 14 on the rear part 7 is stopped at the third shoulder on the main part 12, but it is again sufficient for the user to exert adequate pressure for it to overcome this obstacle and come into final abutting engagement with the fourth shoulder 13. This final position, which corresponds to the active position of the auxiliary reservoir 6, is shown in FIG. 6, with the shoulder 14 on the rear part 7 inextricably trapped between the third and fourth shoulders 12, 13 on the main part 8.

The distance traveled by the shoulder 14 between the inactive position (FIG. 5) and the active position (FIG. 6) is determined so that, in the active position, the front face 6*a* of the auxiliary reservoir 6 penetrates approximately 1 millimeter (mm) into the rear face 3*a* of the main reservoir 3 to allow the transfer of the carrier liquid from the reservoir 6 to the reservoir 3 and also to provide a visual indication of the final stage in the use of the instrument.

To attach the reservoir 6 to the rear end 7*a* of the rear part 7 during normal use of the instrument 1, a tongue 9 on the inside face of the part 7 is pressed onto the front face 6*a* during displacement of the rear part 7 and is pushed back by the main reservoir 3 so that it does not prevent contact between the two reservoirs 3, 6.

Of course, this is not the only feasible embodiment of the invention. It is possible to envisage other ways of immobilizing the rear body 7 relative to the main body 8 and other modes of displacement, for example a displacement that is not merely longitudinal but also involves turning, and is achieved by providing on the inside periphery of the main part 8 a helicoidal groove 8*b* so that the rear part 7 is screwed in, as it were, so that it penetrates into the main part 8, the helicoidal groove being provided with non-return means 8*c* similar to the frustoconical shoulders of complementary shape.

In the case of two fibrous material reservoirs 3, 6, the diameter of the main reservoir 3 is preferably greater than that of the auxiliary reservoir 6. This ensures that the whole of the front face 6*a* of the auxiliary reservoir 6 is pressed against the rear face 3*a* of the main reservoir 3, even if the relative centering of the two reservoirs is less than perfect.

In one particular non-limiting embodiment of the invention, the main reservoir 3 had a diameter of 13.3 mm, a length of 37 mm, contained 3 grams (g) of ink, and had a fiber density of 0.234 g/cm$^3$. The auxiliary reservoir 6 had a diameter of 11.4 mm, a length of 29 mm, contained 1.5 g of carrier liquid, and had a fiber density of 0.23 g/cm$^3$.

The auxiliary reservoir may be a capillary reservoir without constituting a fibrous reservoir, for example a reservoir made from sintered powder, or it may consist of a spongy mass that has absorbed a certain quantity of ink that can be delivered by compressing said spongy mass. In this case, the relative displacement of the rear part 7 must be over a sufficient distance to obtain the required compression effect.

The auxiliary reservoir may equally consist of a sachet containing liquid ink. In this case the actuator part, which may be the rear part 7, must be provided with means for opening said sachet, for example one or more tapered lugs which, on relative displacement of said parts, pierce the sachet to allow the carrier liquid that it contains to flow out. This sachet is located towards the back of the rear part and is held against the rear face 3*a* of the main reservoir 3.

In all the examples given above, the actuator part is displaceable in longitudinal translation in the direction of the axis of symmetry of the instrument 1. This is not the only implementation of the invention, however. For example, in the case of an auxiliary reservoir taking the form of a spongy mass containing the carrier liquid, the actuator part may consist of a portion of the body of the instrument containing the auxiliary reservoir and made from a material that is deformable by compressing it or twisting it, and whose deformation is preferably permanent. It is then sufficient for the user to apply adequate force to this portion of the instrument to deform it and thereby compress the fibrous or spongy mass, releasing the carrier liquid from the auxiliary reservoir. In this case it is the mechanical deformation of this portion of the body of the instrument that provides the visual indication of the end of life of the instrument.

What is claimed is:

1. A writing instrument comprising a body, a main reservoir containing ink and housed in said body, a writing head projecting from a front part of said body, and a capillary connector for transferring ink from the main reservoir to the writing head, wherein said writing instrument also comprises an auxiliary reservoir containing an ink carrier liquid, and actuator means for releasing said liquid from the auxiliary reservoir so that said liquid flows into the main reservoir and expels the ink towards the connector, wherein the main reservoir and the auxiliary reservoir are both fibrous material reservoirs and wherein, upon operations of the actuator means, the auxiliary reservoir is displaced into contact with the main reservoir.

2. A writing instrument according to claim 1, wherein said carrier liquid contains ink solvent.

3. A writing instrument according to claim 2, wherein said ink is water-based and said ink solvent is water.

4. A writing instrument according to claim 1, wherein said ink comprises multiple components, and said carrier liquid contains all or any of the components of the ink in the main reservoir, whereby the original writing properties of the residual ink carried by the carrier liquid are preserved.

5. A writing instrument according to claim 4, of water-based ink type, wherein the carrier liquid contains glycol.

6. A writing instrument according to claim 4, of dry-wipe ink type, wherein the carrier liquid contains a resin conferring its dry-wipe properties on the ink.

7. A writing instrument according to claim 1, wherein the carrier liquid contains at least one surfactant.

8. A writing instrument according to claim 1, wherein the quantity of carrier liquid is of the order of 20% to 40% of the quantity of ink contained in the main reservoir.

9. A writing instrument according to claim 1, wherein the main reservoir and the auxiliary reservoir are disposed in the body of the instrument in the same longitudinal direction and wherein the auxiliary reservoir has a front face pressed onto a rear face of the main reservoir when they are brought into contact.

10. A writing instrument according to claim 1, wherein the auxiliary reservoir has capillarity lower than the main reservoir.

11. A writing instrument according to claim 10, wherein the fiber density of the auxiliary reservoir is from 80% to 95% of the fiber density of the main reservoir.

12. A writing instrument according to claim 1, wherein the diameter of the main reservoir is greater than the diameter of the auxiliary reservoir.

13. A writing instrument according to claim 1, wherein the auxiliary reservoir is housed in an actuator part that is a rear part mounted to slide relative to the body of the instrument containing the main reservoir, the capillary transfer means and the writing head.

14. A writing instrument according to claim 13, wherein the body of the instrument comprises means for retaining the actuator part adapted to retain it temporarily in an inactive position and, upon operation of said actuator part, to move it to an active position and to retain it inextricably in said active position.

15. A writing instrument according to claim 14, wherein the means for retaining the actuator part comprise:

a) a substantially frustoconical annular shoulder on an outside periphery of the actuator part, and b) on an inside periphery of the main part of the body, facing said shoulder, four annular shoulders, of which a first shoulder and a fourth shoulder form definitive abutments and a second shoulder and a third shoulder, having a frustoconical shape complementary to that of the shoulder carried by the actuator part, form temporary abutments.

16. A writing instrument according to claim 14, wherein the actuator part undergoes longitudinal and rotational displacement by virtue of a helicoidal groove provided on the inside periphery of the main part, allowing the actuator part to penetrate into the main part, said groove being provided with non-return means.

* * * * *

UNITED STATES PATENT AND TRADEMARK OFFICE

CERTIFICATE OF CORRECTION

PATENT NO. : 7,470,079 B2
APPLICATION NO. : 10/522179
DATED : December 30, 2008
INVENTOR(S) : Vincent R. M. Bedhome et al.

It is certified that error appears in the above-identified patent and that said Letters Patent is hereby corrected as shown below:

Column 6, line 58, reads "operations" should read -- operation --

Signed and Sealed this

Eighteenth Day of August, 2009

David J. Kappos

David J. Kappos
*Director of the United States Patent and Trademark Office*